US006312187B1

(12) United States Patent
Walter

(10) Patent No.: US 6,312,187 B1
(45) Date of Patent: Nov. 6, 2001

(54) STREET TUNNEL ARRANGEMENT ACCESSIBLE TO VEHICLES IN DENSELY POPULATED AREAS

(76) Inventor: Ignaz Walter, Siebenbrunner Strasse 14, D-86179 Augsburg (DE)

( * ) Notice: Subject to any disclaimer, the term of this patent is extended or adjusted under 35 U.S.C. 154(b) by 0 days.

(21) Appl. No.: 09/433,493

(22) Filed: Nov. 3, 1999

(30) Foreign Application Priority Data

Nov. 5, 1998 (DE) ..... 198 50 937

(51) Int. Cl.[7] ..... E01C 1/00
(52) U.S. Cl. ..... 404/1
(58) Field of Search ..... 404/1

(56) References Cited

U.S. PATENT DOCUMENTS

| | | | | |
|---|---|---|---|---|
| 1,661,490 | * | 3/1928 | Mihaliak | 404/1 |
| 2,941,454 | * | 6/1960 | Cedeno | 404/1 |
| 3,533,062 | * | 10/1970 | Coffman | 404/1 |
| 3,675,584 | * | 7/1972 | Hall | 404/1 |
| 3,847,496 | | 11/1974 | Stankiewicz . | |
| 3,945,745 | * | 3/1976 | Chang | 404/1 |
| 4,272,210 | * | 6/1981 | Shoji et al. | 404/1 |
| 4,927,288 | * | 5/1990 | Raswant | 404/1 |

FOREIGN PATENT DOCUMENTS

| | | | | |
|---|---|---|---|---|
| 2 221 627 | | 11/1973 | (DE) . | |
| 806019 | * | 6/1951 | (DE) | 404/1 |
| 4135693-A1 | * | 4/1993 | (DE) | 404/1 |
| 848739 | * | 9/1960 | (GB) | 404/1 |
| 2 202 562 A | * | 9/1988 | (GB) | 404/1 |

OTHER PUBLICATIONS

Scientific American, vol. XCVL—No. 25, pp. 505 and 510, Jun. 1907.*

Patent Abstracts of Japan; vol. 17/No. 181; JP 4–336102, dated Nov. 24, 1992 (1 page).

* cited by examiner

*Primary Examiner*—David Bagnell
*Assistant Examiner*—Gary S. Hartmann

(57) ABSTRACT

A street tunnel arrangement accessible to vehicles in densely populated areas. The above-ground and underground arrangement of streets extending in tunnels in densely populated areas does not meet the increasing growth of traffic in large cities. The purpose to develop a concept to solve the traffic problem in densely populated areas is attained in such a manner that at least one ring street arranged along the periphery of the densely populated area and a plurality of tunnels, which are arranged at regular intervals within said ring street and extend at a depth below the public utility systems of the densely populated area, and a plurality of underground parking garages, which are accessible through the tunnels and have access devices to the surface of the densely populated area, are provided. The tunnels are designed either as ring tunnels or as series of parallel tunnels arranged at an angle with respect to one another and at various depths underneath the ground.

17 Claims, 4 Drawing Sheets

STREET TUNNEL ARRANGEMENT ACCESSIBLE TO VEHICLES IN DENSELY POPULATED AREAS

FIELD OF THE INVENTION

The invention relates to a street tunnel arrangement accessible to vehicles in densely populated areas, and more particularly to a plurality of tunnels accessible from a ring street at the periphery of the densely populated area.

BACKGROUND OF THE INVENTION

It is estimated that traffic in Europe will continue to significantly increase during the next approximately 10 years and that the traffic in threshold and developing countries will continue to significantly increase during the next approximately 30 years. The largest increase in traffic will occur in the so-called megacities, that is metropolitan and densely populated areas with many millions of inhabitants. Independent of the public transportation systems, in particular the local public people-moving systems in such cities, the existing inner city streets will no longer be able to handle this increase in traffic. Also a substantial shift of the public to the local public people-moving system is not plausible, not only because of a lack of acceptance, but also because the local public people-moving systems do not have the capacity to absorb an additional large portion of the public.

Therefore, the purpose exists to develop a concept to solve the traffic problems in densely populated areas and megacities.

The solution of the invention for traffic problems of megacities is based on the city or the densely populated area scientifically moving traffic underground through tunnels. These tunnels lie far enough underneath the surface of the earth that they are no longer within the area of the public utility services and the subway. A depth of 30 to 50 m is sufficient for this in most cases. The tunnels are constructed in a conventional manner. The problems arising hereby, for example, the support of the weight of the ground, drainage of ground water, and ventilation, have already been solved in the field of tunnel construction.

SUMMARY OF THE INVENTION

The drawbacks and problems associated with traffic in densely populated areas are believed overcome by providing a plurality of street tunnels arranged within a ring street. Parking houses or parking garages are developed according to the invention adjacent this underground tunnel system, namely at strategically important points under the city center. Access devices like elevators or steps for persons and goods lead from these parking houses to the surface. The parking houses exist preferably at junction points of the above-ground people-moving systems in order to enable a direct change to the local and long-distance transportation systems. Furthermore, the parking houses are intended to provide direct access to important office buildings, governmental buildings, shopping centers and other inner-city areas, which must be reached daily by many people. In as far as parking houses and access devices to the surface cannot be provided at all desired points, the important in-nercity areas must at any rate be quickly accessible by foot.

Part of the concept of the invention is also to feed the traffic coming from outside the city into the tunnel system. This is done by the ring street surrounding the densely populated area or the city, which ring street can be provided above ground or even underground within a ring tunnel and is connected through feed tunnels to the inner tunnel system. Instead of a ring tunnel or a ring street it is also possible to provide several ring streets at various distances from the center of the densely populated area. These can also be connected directly to a by-pass road or a by-pass ring.

As a result the inner-city motor-vehicle passenger traffic is removed from the existing, above-ground city streets and is shifted underground. The above-ground city streets are only needed for special traffic tasks, for example, special deliveries, fire department uses, etc. The above-ground streets are otherwise blocked to individual vehicles or can be travelled only by special permit. The long-distance and through traffic is directed in a conventional manner through large, above-ground ring roads around the city or the densely populated area.

BRIEF DESCRIPTION OF THE DRAWINGS

One exemplary embodiment of the invention will be described in greater detail hereinafter with reference to the accompanying drawings, in which.

DETAILED DESCRIPTION

Figure 1:
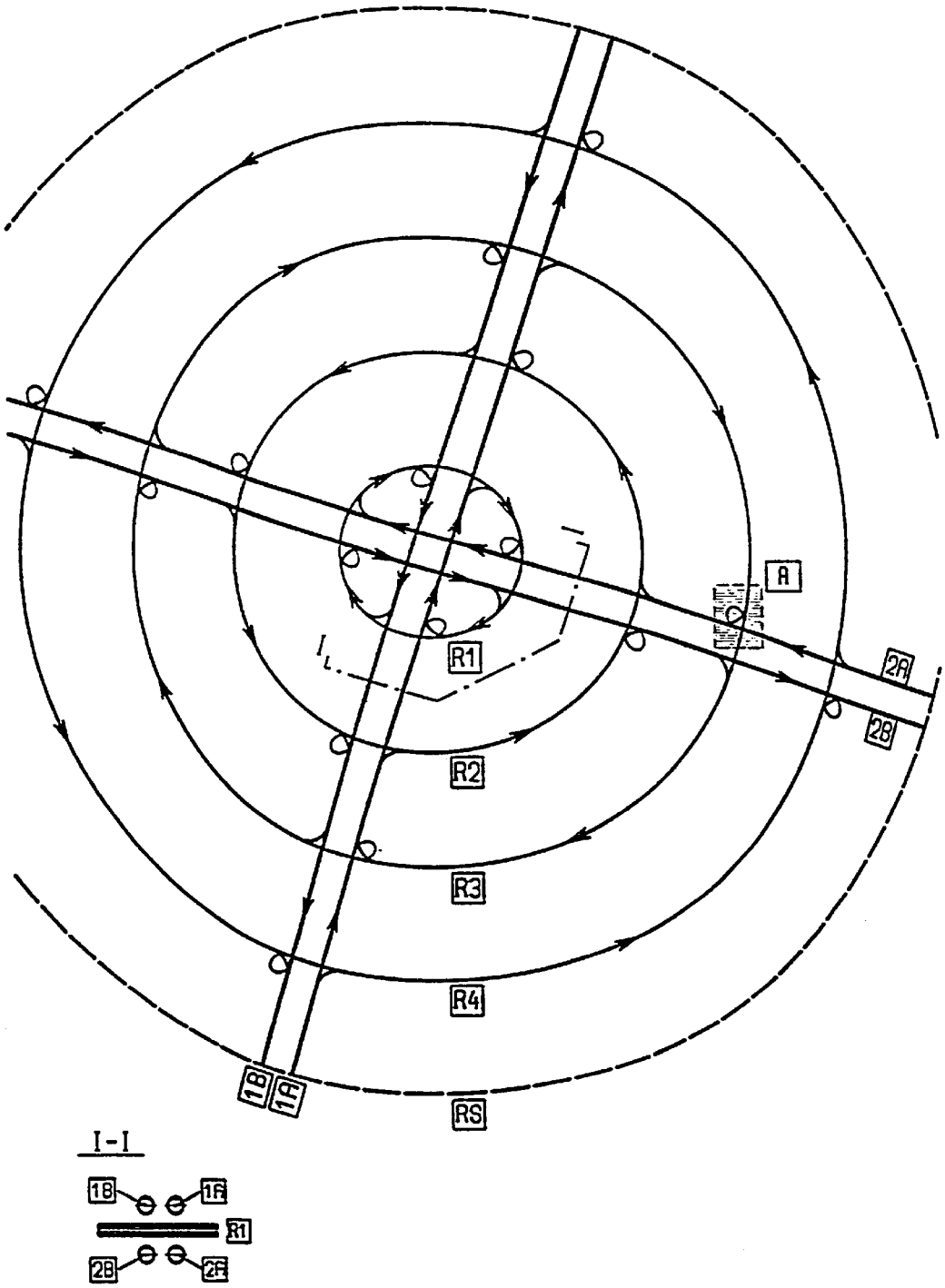
FIG. 1 is a schematic top view of a first embodiment of the invention.

A first system according to the present invention is illustrated in FIG. 1. It shows a first pair of tunnels comprising two individual tunnels 1A, 1B, which pair of tunnels diametrically crosses a city in a linear direction. The two tunnels 1A, 1B hereby extend parallel; each tunnel is designed for one-way traffic and houses a street with, for example, three lanes. The pair of tunnels 1A, 1B exist below the surface of the earth at a depth of approximately 30 m.

The distance between the two tunnels 1A, 1B is also approximately 30 m.

A second pair of tunnels 2A, 2B extends approximately perpendicular with respect to the first pair 1A, 1B. This pair of tunnels is also spaced approximately 30 m from one another and diametrically crosses linearly through the center of the city. Also, each tunnel of this pair is designed for one-way traffic and houses, for example, a street with three lanes. The depth of the second pair of tunnels 2A, 2B is clearly below the depth of the first pair, for example 30 m below, i.e. 60 m below the ground surface. The two pairs 1A, 1B; 2A, 2B can in this manner bypass each other without interference approximately at the center of the city.

The feeding of traffic into the two pairs of tunnels 1A, 1B; 2A, 2B occurs from the ring street (not illustrated) surrounding the densely populated area.

In addition to the two described tunnel pairs 1A, 1B; 2A, 2B, ring tunnels R1 to R4 are provided concentrically with respect to the point of intersection of these pairs of tunnels, which point of intersection is provided approximately in the center of the city. The diameter of the first, innermost ring tunnel is 1,200 to 1,600 m. The further ring tunnels follow at an increased diameter of approximately 800 m, e.g. 2,000 m, 2,800 m, etc. The first ring tunnel R1 houses a one-way street, on which the traffic is guided clockwise, the adjacent outer ring tunnel R2 houses a one-way street with the traffic moving counterclockwise. Each successive ring tunnel thus houses a one-way street with alternating traffic flow directions relative to the adjacent ring tunnels. The number of ring tunnels corresponds with the size of the city or the densely populated area and is not limited.

Figure 2:
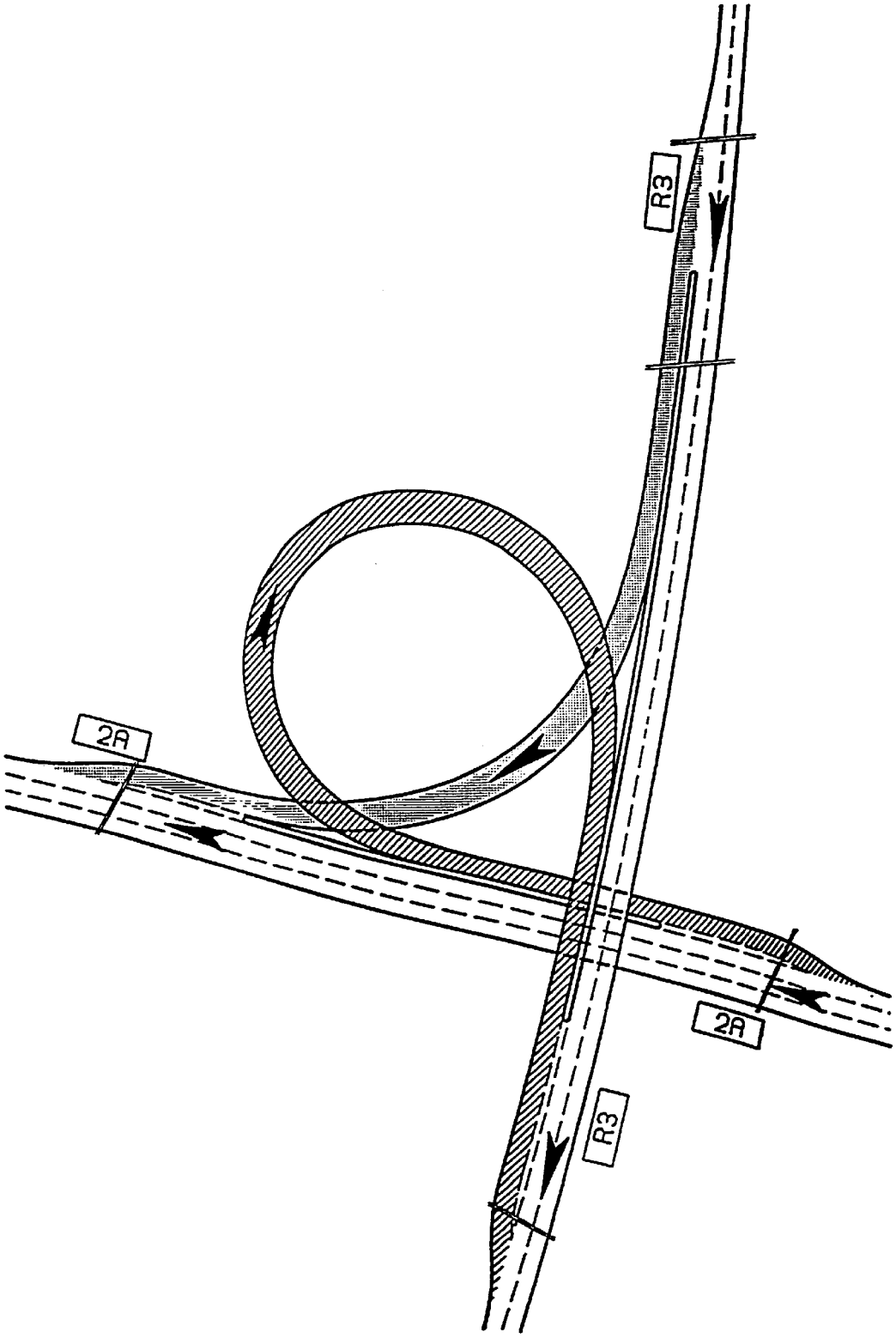
FIG. 2 is a detailed illustration of the area A of FIG. 1.

The ring tunnels R1 to R4 lie at a depth between the depth of the first pair 1A, 1B and second pair 2A, 2B of tunnels. The traffic connection of the tunnels 1A, 1B and 2A, 2B to the ring tunnels R1 to R4 is accomplished by turn-off lanes and loops, as is schematically illustrated in FIG. 2 using as an example the intersection of straight tunnel 1A and ring tunnel R3. The traffic coming from the ring tunnel R3 can turn off on a turn-off lane to the right into the tunnel 1A leading to the center of the city. Furthermore, the traffic moving at the periphery in the tunnel 1A toward the center of the city can turn off to the left into the ring tunnel R3 over the illustrated loop. The illustrated exemplary embodiment requires 16 loops and 32 turn-off lanes. This number depends, however, on the number of tunnel pairs and the number of ring tunnels, here two tunnel pairs and four ring tunnels.

Since the ring tunnels R1 to R4 lie at a different depth than the pairs of tunnels 1A, 1B and 2A, 2B, a depth change also occurs with each turn-off process, which, however, when the turn-off lanes are designed sufficiently long is not an actual problem.

Figure 3:
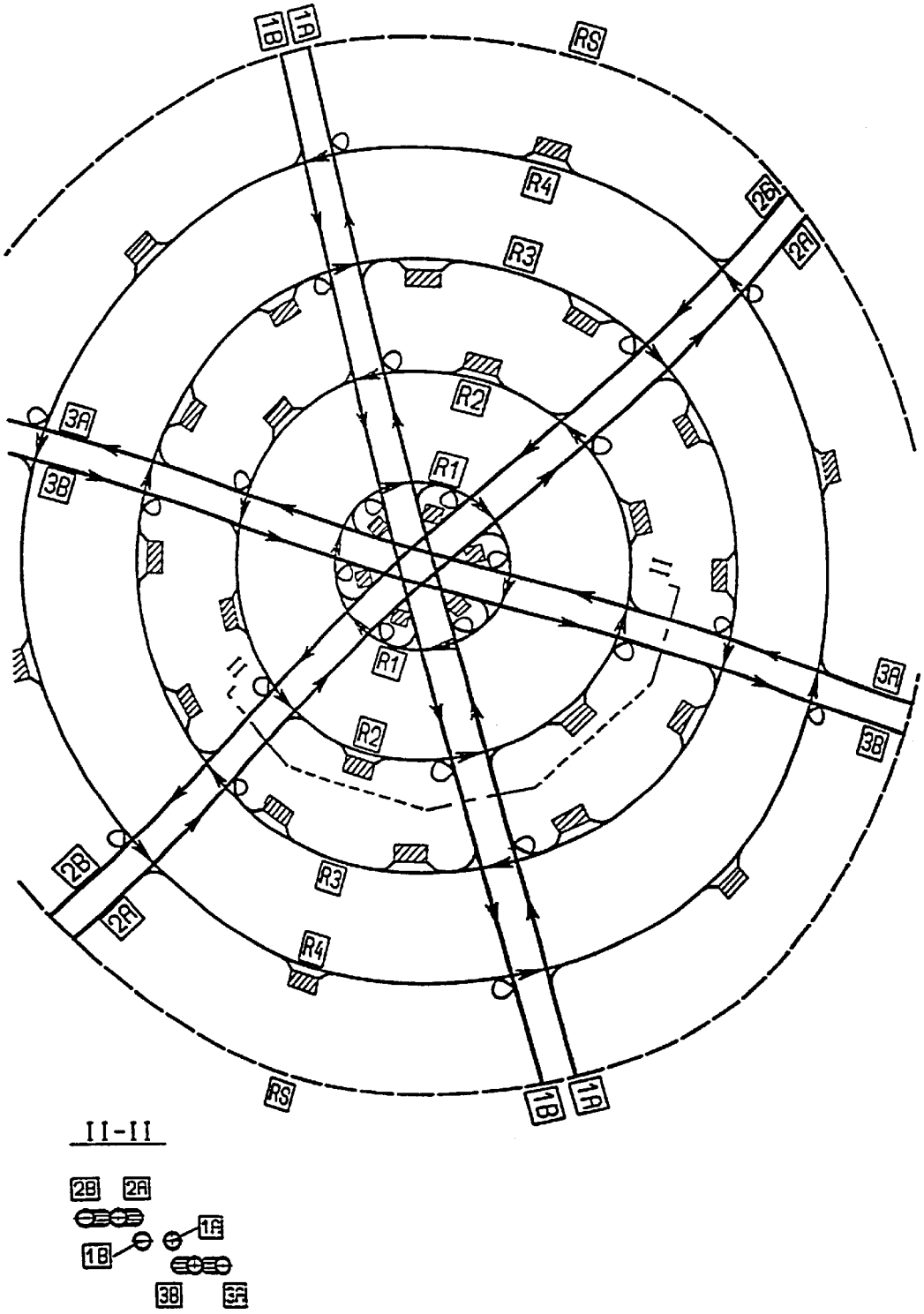
FIG. 3 is a schematic top view of an alternative embodiment of the invention with the basic concept of the embodiment according to FIGS. 1 and 2.

Of course, neither the number of ring tunnels R1 to R4 nor the number of pairs of tunnels 1A, 1B or 2A, 2B is limited. FIG. 3, for example, shows an arrangement with 3 pairs of tunnels 1A, 1B, 2A, 2B and 3A, 3B.

Figure 4:
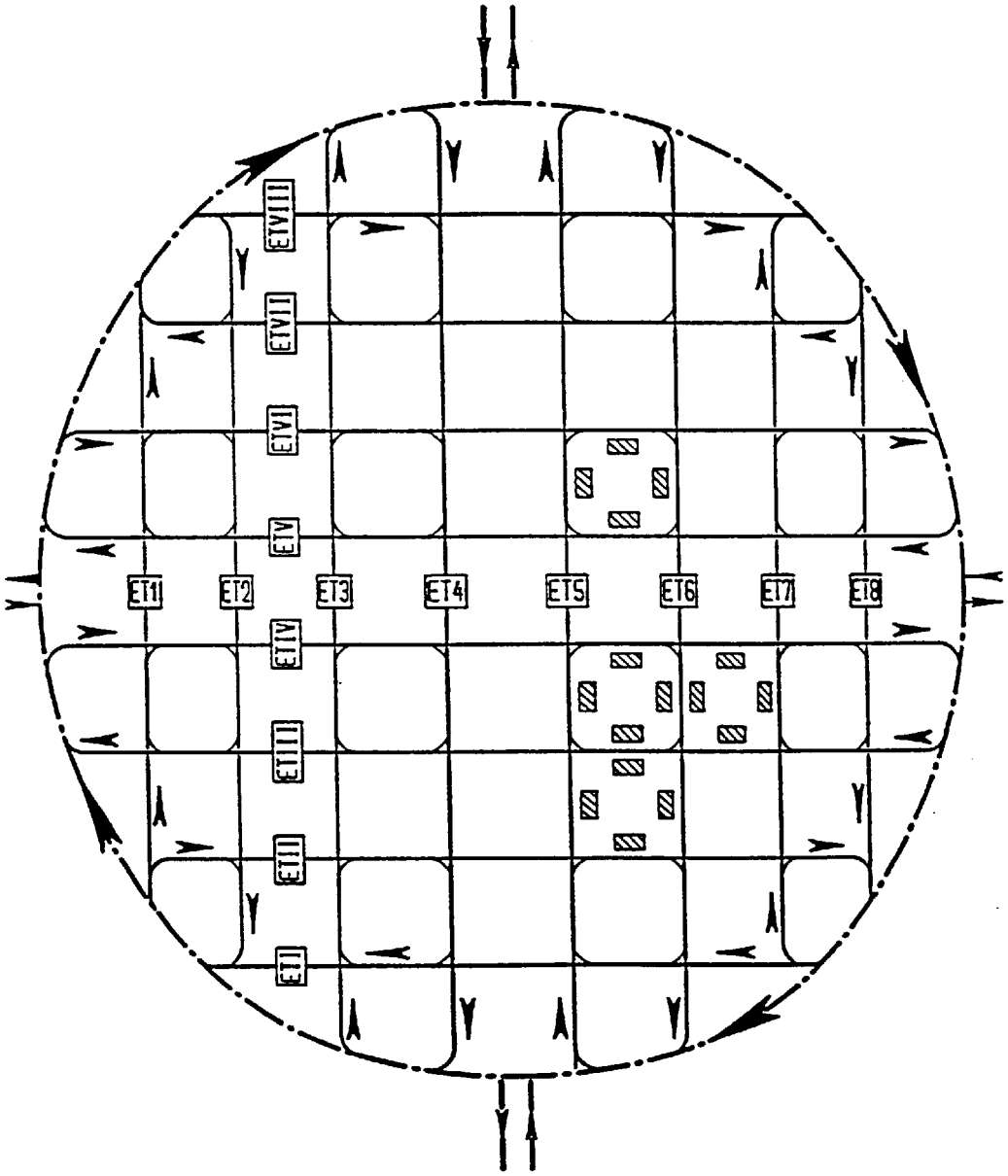
FIG. 4 is a schematic top view of a further alternative embodiment of the invention.

A further embodiment of the concept of the invention is shown in FIG. 4. Instead of the ring tunnel system, a quadratically arranged tunnel system is used here. Same consists of a first plurality of tunnels ET 1 to ET 9, which extend parallel to one another at a distance of approximately 1,000 m, and a second plurality of tunnels ET I to ET IX, which also extend parallel to one another at a distance of approximately 1,000 m. The two pluralities of tunnels are positioned at an angle of approximately 90° to one another, and thus form an orthogonal grid.

Each tunnel of the first plurality and each tunnel of the second plurality have a street with one or several lanes. The direction of travel in adjacent tunnels is opposite in each case.

The feeding of the traffic is also done over a ring street or a ring tunnel (not illustrated) as discussed above with the first embodiment.

The first plurality of tunnels ET 1 to ET 9 lies at a different level than the second plurality ET I to ET IX in order to enable undisturbed bypass of the crossing tunnels. Turning off to the right is advantageously permitted so that turning off to only one side occurs here.

The depth of the first plurality of tunnels ET 1 to ET 9 lies approximately 50 m under the surface of the earth whereas the second plurality lies approximately 5–10 m deeper.

The arrangement and servicing of parking houses is essentially the same in both systems. Parking houses are placed at strategically important points and access devices like lifts and stairs lead to the surface from these parking houses.

Although particular preferred embodiments of the invention have been disclosed in detail for illustrative purposes, it will be recognized that variations or modifications of the disclosed apparatus, including the rearrangement of parts, lie within the scope of the present invention.

The invention claimed is:

1. A street tunnel arrangement accessible to vehicles in densely populated areas, comprising at least one ring street arranged along a periphery of the densely populated area, a plurality of street tunnels arranged within said ring street at regular intervale and including a first pair of linear and side-by-side extending tunnels crossing the densely populated area at a first depth, and at least one second pair of linear and side-by-side extending tunnels crossing the densely populated area at a second depth, the first pair and the second pair of tunnels bypassing each other at a point approximately at a center of the densely populated area, said plurality of street tunnels receiving traffic from said ring street and extending at a depth below public utility services, and a plurality of underground parking garages, which are developed with respect to traffic through the street tunnels and having access devices for persons and goods between the tunnel arrangement and a surface of the densely populated area.

2. The tunnel arrangement according to claim 1, wherein the ring street is arranged underground in a tunnel.

3. The tunnel arrangement according to claim 1, wherein the street tunnels lie at a depth of 30–50 meters underneath the surface of the earth.

4. The tunnel arrangement according to claim 1, wherein several ring streets extending above ground or in the street tunnels are arranged at selected distances from the center of a densely populated area.

5. The tunnel arrangement according to claim 1, wherein only a single one-way street is arranged in each of the street tunnels.

6. The tunnel arrangement according to claim 1, wherein connecting points of a local public traffic system and a public long-distance traffic system are directly accessible through the access devices.

7. The tunnel arrangement according to claim 1, wherein exactly two pairs of the linear and side-by-side extending tunnels are provided, which intersect at an angle of approximately 90° at the center of the densely populated area.

8. The tunnel arrangement according to claim 1, wherein a plurality of ring streets are arranged in tunnels and are provided concentrically with respect to the point of bypass of the first and second pair of linear and side-by-side extending tunnels, successive ones of the ring tunnels housing oppositely running one-way streets, and the ring tunnels are connected to the pairs of linear and side-by-side tunnels through loops or turn-off lanes.

9. The tunnel arrangement according to claim 8, wherein a ring formed by the innermost one of the ring tunnels has a diameter of between 1,000 and 2,000 meters, and the ring tunnels are spaced from adjacent ring tunnels by a distance of between 500 and 1,200 meters.

10. The tunnel arrangement according to claim 8, wherein the first pair of linear and side-by-side tunnels are arranged at the same level spaced approximately 30 meters from one another, the second pair of linear and side-by-side tunnels are arranged with their apexes approximately 30 meters below the first pair of linear tunnels, and the ring tunnels are arranged elevationally between the first pair and the second pair of linear tunnels.

11. The tunnel arrangement according to claim 1, wherein the access devices from the parking garages to the surface of the densely populated area are at least one of steps or elevators for transporting persons and goods to and from the surface.

12. A street tunnel arrangement accessible to vehicles in densely populated areas, comprising at least one ring street arranged along a periphery of the densely populated area, a first plurality of linear tunnels crossing the densely populated area parallel to one another and at regular intervals arranged within said ring street, and a second plurality of linear tunnels crossing the densely populated area parallel to one another and at regular intervals within said ring street, whereby the second plurality of linear tunnels extends essentially perpendicularly with respect to the first plurality of linear tunnels and is arranged at a different depth, said linear tunnels receiving traffic from said ring street and extending at a depth below public utility services, and a plurality of underground parking garages, which are developed with respect to traffic through the linear tunnels and having access devices for persons and goods between the tunnel arrangement and a surface of the densely populated area.

13. The tunnel arrangement according to claim 12, wherein the first plurality of linear tunnels is arranged approximately 50 meters under the surface of the earth and the second plurality of linear tunnels is arranged at a vertical distance of approximately 10 meters from the first plurality of linear tunnels.

14. The tunnel arrangement according to claim 12, wherein adjacent tunnels of the first plurality and of the second plurality of linear tunnels each house one-way streets with opposite traffic directions.

15. A street tunnel arrangement accessible to vehicles in a densely populated area, comprising:

at least one ring street arranged along a periphery of the densely populated area;

a first pair of tunnels each containing a one way street crossing the densely populated area parallel to one another and extending to a depth below public utility services;

a second pair of tunnels each containing a one way street crossing the densely populated area, the second pair of tunnels extending to a depth below public utility service and having a different depth than the first pair of tunnels, said second pair of tunnels crossing the first pair of tunnels at a bypass point near a center of the densely populated area, each of said tunnels containing a one way street;

a plurality of street tunnels provided concentrically with respect to the bypass point and arranged within said ring street at regular intervals for receiving traffic from said first and second pairs of tunnels, said street tunnels extending to a depth below public utility services and adjacent ones of said street tunnels containing one way streets in opposing directions;

a plurality of underground parking garages, which are accessible for traffic through said street tunnels; and access devices for persons and goods between the tunnel arrangement and a surface of the densely populated area.

16. The tunnel arrangement according to claim 15, wherein said plurality of street tunnels have a different depth than said first and second pairs of tunnels.

17. The tunnel arrangement according to claim 15, wherein said ring street is arranged underground in a tunnel.

* * * * *